US007303514B2

(12) United States Patent
Ish, III et al.

(10) Patent No.: US 7,303,514 B2
(45) Date of Patent: Dec. 4, 2007

(54) APPARATUS AND METHODS FOR MOVEABLE EXERCISE BENCHES

(75) Inventors: A. Buell Ish, III, Redmond, WA (US); W. Douglas MacLean, Issaquah, WA (US)

(73) Assignee: Vectra Fitness, Inc., Kent, WA (US)

( * ) Notice: Subject to any disclaimer, the term of this patent is extended or adjusted under 35 U.S.C. 154(b) by 140 days.

(21) Appl. No.: 10/913,136

(22) Filed: Aug. 5, 2004

(65) Prior Publication Data

US 2006/0030461 A1 Feb. 9, 2006

(51) Int. Cl.
*A63B 21/00* (2006.01)
*A63B 21/062* (2006.01)

(52) U.S. Cl. ..... 482/133; 482/99; 482/101; 482/138

(58) Field of Classification Search ..... 482/72, 482/96, 97, 99–101, 142, 145, 133–135, 482/138, 139
See application file for complete search history.

(56) References Cited

U.S. PATENT DOCUMENTS 4,728,101 A 3/1988 King
4,793,608 A * 12/1988 Mahnke et al. ..... 482/98
4,875,676 A 10/1989 Zimmer
5,072,929 A * 12/1991 Peterson et al. ..... 482/72
5,356,360 A 10/1994 Johns
5,417,634 A 5/1995 Habing
5,460,587 A * 10/1995 Hutchins ..... 482/101
5,472,397 A 12/1995 Ammoscato et al.
5,549,533 A 8/1996 Olson et al.
5,597,375 A 1/1997 Simonson
5,672,143 A 9/1997 Ish, III
5,779,601 A 7/1998 Ish, III
5,823,921 A 10/1998 Dawson
6,447,430 B1 9/2002 Webb et al.
6,595,905 B2 * 7/2003 McBride ..... 482/130
6,746,378 B2 6/2004 Morris et al.

* cited by examiner

*Primary Examiner*—Stephen R. Crow
*Assistant Examiner*—Allana Lewin
(74) *Attorney, Agent, or Firm*—Lee & Hayes, PLLC

(57) ABSTRACT

Moveable exercise benches are disclosed. In one embodiment, an exercise machine includes a load, an exercise station, and a force-transferring assembly operatively coupling the exercise station and the load. A moveable support is positioned proximate the exercise station and is adapted to support a user during an exercise. The force-transferring assembly is adapted to allow the moveable support to move without decoupling the force-transferring assembly from the exercise station and to allow use of the exercise station at any location of the moveable support without adjustment. The force-transferring assembly may be a cable-and-pulley assembly. In an alternate embodiment, the force-transferring assembly may be adapted to apply a counter force on the moveable support that at least partially counters a reactive force applied by the user to the moveable support during the exertion of the exercising force.

37 Claims, 5 Drawing Sheets

APPARATUS AND METHODS FOR MOVEABLE EXERCISE BENCHES

FIELD OF THE INVENTION

This invention relates to moveable exercise benches, and more specifically, to apparatus and methods for moveable exercise benches that allow improved movability and that may provide a counteracting force during use of an exercise station.

BACKGROUND OF THE INVENTION

Weight training machines are highly popular with people interested in exercising to maintain their health and appearance. Conventional weight training machines typically include a weight stack that provides an adjustable load, and one or more exercise stations coupled to the weight stack that enable a person to exercise different portions of the body. At a first exercise station, for example, a user may stand upright to perform a desired exercise. Alternately, at other exercise stations, the user may sit in an upright or reclined position, or may lie in a supine or prone position, to perform the desired exercises. Thus, a common component of conventional exercise machines is a seat or bench for supporting the user in a sitting, supine, or prone position during an exercise.

FIG. 1 is a side elevational view of a portion of an exercise machine 100 that includes a bench 120 in accordance with the prior art. In this example, the exercise machine 100 includes a press station 102 and a leg station 104. The press station 102 includes a press arm 106 pivotally coupled to an upright member 108 of a support frame 109. A cable-and-pulley assembly 110 operatively couples the leg station 104 to a weight stack or other suitable load (not shown). In FIG. 1, the cable-and-pulley assembly 110 includes a cable 112 that is engaged with a pulley 114 disposed within the upright member 108 and that extends between the leg station 104 and the weight stack.

In operation, a user may position the bench 120 in a first position 122 that supports the user in a supine position (e.g. for performing bench press exercises using the press station 102). Similarly, the user may position the bench 120 in a second position 124 that supports the user in a sitting position (e.g. for performing leg extensions using the leg station 104). The exercise machine 100 shown in FIG. 1 is generally representative of a variety of conventional exercise machines, including, for example, those devices described in U.S. Pat. No. 5,779,601 issued to Ish, U.S. Pat. No. 5,549,533 issued to Olson et al., and U.S. Pat. No. 4,793,608 issued to Mahnke et al., which patents are incorporated herein by reference.

To accommodate users of various sizes, it may be desirable to move the bench 120 closer to or away from the upright member 108 along a lengthwise axis 126 (FIG. 1), such as, for example, to facilitate use of the press station 102. As shown in FIG. 1, this may be accomplished by providing an engagement member 128 of the bench 120 that slideably engages a horizontal member 130 of the support frame 109. This arrangement enables the user to slide the bench 120 back and forth along the horizontal member 130, allowing the user to adjust the position of the bench 120 with respect to the press station 102 as desired. In some exercise machines, to prevent the bench 120 from moving along the lengthwise axis 126 due to forces exerted on the bench 120, a locking assembly 132 may be provided which selectively locks the bench 120 in the desired position relative to the support frame 109.

Although desirable results have been achieved using prior art exercise machines, there is room for improvement. In some prior art exercise machines, for example, when a user desires to move the bench 120 along the lengthwise axis 126 in a direction away from the upright member 108 for using the press station 102, the user must disconnect the leg station 104 from the cable 112. Since the leg station 104 may be coupled to the bench 120, both the leg station 104 and the bench 120 may then be moved in the desired direction away from the upright member 108 along the lengthwise axis 126. On the other hand, when the user desires to use the leg station 104, since the cable 112 is of fixed length, the bench 120 and the leg station 104 must be repositioned at a location that is close enough to the upright member 108 to enable the leg station 104 to be reconnected to the cable 112. This process of disconnecting and reconnecting the leg station 104 from the cable 112 may cause undesirable delay and inconvenience during exercising.

Also, in some prior art multi-station exercise machines, other exercise stations may be coupled to the weight stack and may cause a tension on the cable 112 when used. In such a case, if the bench 130 is drawn outwardly away from the upright member 108 and another exercise station is used that causes a tension on the cable 112, the bench 130 may inadvertently be pulled inwardly toward the upright member 108, thereby degrading the user's exercise. This may occur particularly with exercise machines that do not have the locking assembly 132.

Furthermore, in the exercise machine 100 shown in FIG. 1, in order to adjust the position of the bench 120 along the lengthwise axis 126, a user must decouple the bench 120 from the support frame 109 by disengaging the locking assembly 132. The user may be inconvenienced and may experience frustration while performing this task for various reasons (e.g. inaccessible or inconvenient location of the locking assembly 132, difficulty in actuating the locking assembly 132, etc).

To avoid this inconvenience, the locking assembly 132 may be eliminated, however, this may allow the bench 120 to move undesirably along the lengthwise axis 126 during an exercise. Furthermore, after moving the bench 120 to the desired position, the user may forget to re-engage the locking assembly 132, which may also allow the bench 120 to move undesirably during an exercise. Finally, because the locking assembly 132 may be frequently engaged and disengaged, time and expense may be required to maintain the locking assembly 132 in proper working order. For these reasons, novel apparatus and methods that mitigate these characteristics of prior art exercise machines would be useful.

SUMMARY OF THE INVENTION

The present invention is directed to apparatus and methods for moveable exercise benches. Embodiments of apparatus and methods in accordance with the present invention may advantageously allow the position of a bench or other moveable support to be changed without the need for disconnecting and reconnecting an exercise station, and may also provide a counteracting force that at least partially counteracts a reactive force exerted by a user on the moveable bench during use. Embodiments of the present invention may also reduce the inconvenience that may be experienced by a user during re-positioning of the bench between exercises, and may reduce the maintenance associated with prior art apparatus.

In one embodiment, an exercise machine includes a load, an exercise station, and a force-transferring assembly operatively coupling the exercise station and the load and adapted to transmit an exercising force exerted by the user on the exercise station to the load. A moveable support is positioned at least proximate to the exercise station and is adapted to support a user during an exercise. The force-transferring assembly is adapted to allow the moveable support to move without decoupling the force-transferring assembly from the exercise station. The force-transferring assembly may be a cable-and-pulley assembly. In a specific embodiment, the force-transferring assembly includes a first cable having a first portion coupled to the exercise station and a second portion coupled to the moveable support.

In an alternate embodiment, the force-transferring assembly operatively coupling the exercise station and the load may be further adapted to apply a counter force on the moveable support that at least partially counters a reactive force applied by the user to the moveable support during the exertion of the exercising force.

BRIEF DESCRIPTION OF THE DRAWINGS

Preferred and alternative embodiments of the present invention are described in detail below with reference to the following drawings.

DETAILED DESCRIPTION

The present invention relates to apparatus and methods for moveable exercise benches. Many specific details of certain embodiments of the invention are set forth in the following description and in FIGS. 2-9 to provide a thorough understanding of such embodiments. One skilled in the art will understand, however, that the present invention may have additional embodiments, or that the present invention may be practiced without several of the details described in the following description.

In general, apparatus and methods in accordance with the present invention may advantageously allow the position of a bench or other moveable support to be changed without the need for disconnecting and reconnecting an exercise station, and may also eliminate conventional locking mechanisms for securing a bench to a support frame of an exercise machine. More specifically, moveable exercise benches having a force transfer assembly in accordance with the present invention may provide the desired functions of allowing the bench to be moveable without the need to disconnect an exercise station, and may also prevent the bench from moving during an exercise in a manner that greatly improves the ease and convenience of the process of adjusting the position of the bench for a different exercise in comparison with the prior art. Also, because the need for a conventional locking assembly is eliminated, the costs associated with maintaining the exercise machine may be reduced and the user's overall satisfaction with the exercise machine may be improved.

Figure 2:
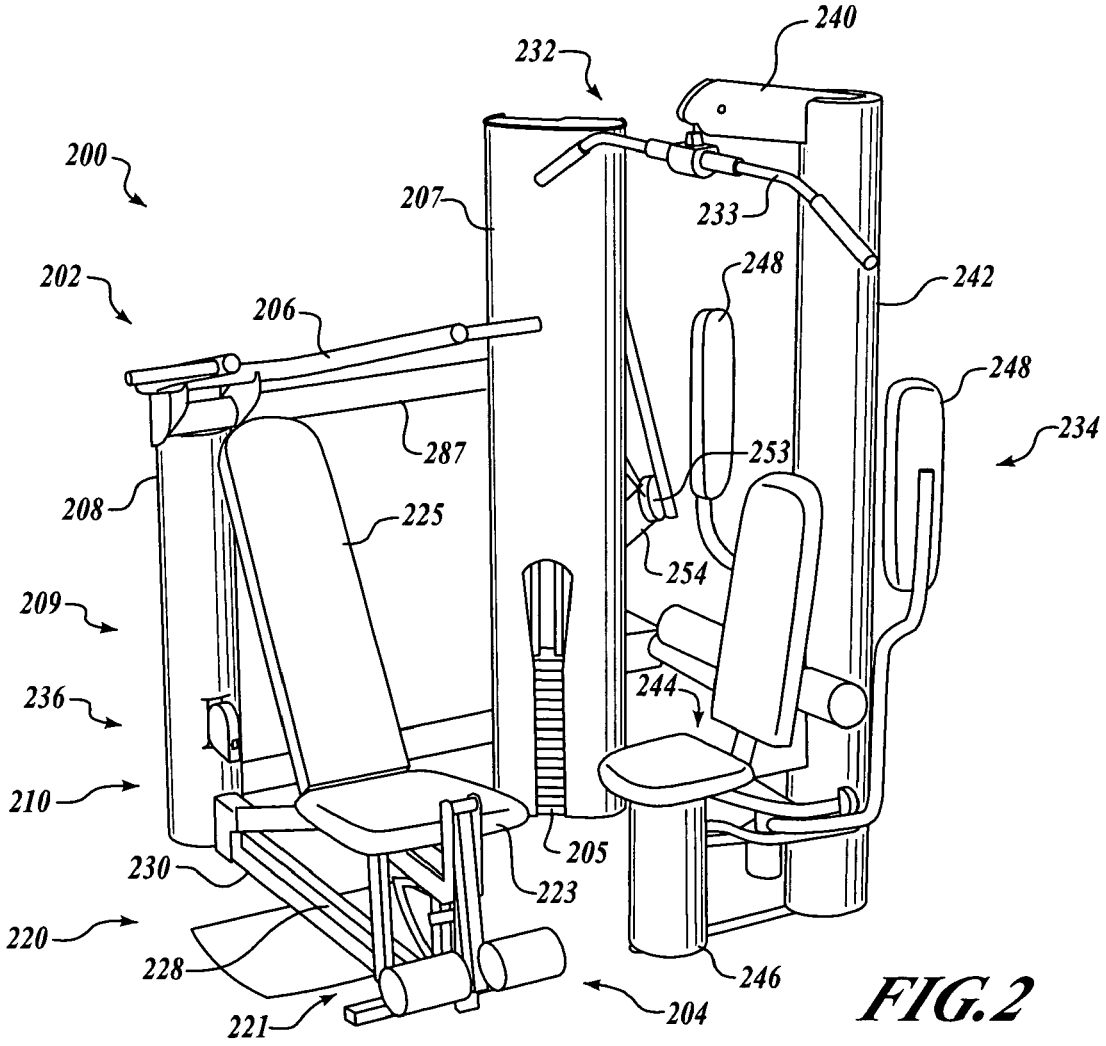
FIG. 2 is an isometric view of an exercise machine having a moveable bench in accordance with an embodiment of the present invention.
Figure 3:
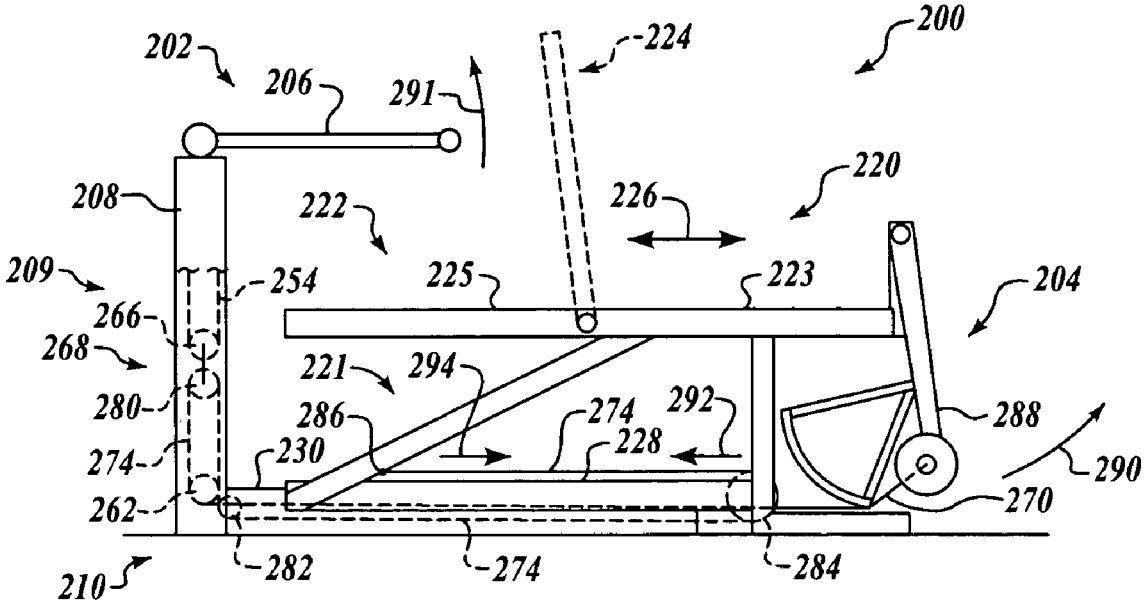
FIG. 3 is an enlarged, side elevational view of the moveable bench of the exercise machine of FIG. 2.

FIG. 2 is an isometric view of an exercise machine 200 having a moveable bench 220 in accordance with an embodiment of the present invention. FIG. 3 is an enlarged, side elevational view of a portion of the exercise machine 200 of FIG. 2. As shown in FIGS. 2 and 3, the exercise machine 200 includes a press station 202 proximate a first end of the moveable bench 220, and a leg station 204 at least proximate to (including possibly attached to) a second end of the moveable bench 220. The press station 202 includes a press arm 206 pivotally coupled to a first upright member 208 of a support frame 209. A first horizontal member 230 of the support frame 209 extends along a floor surface beneath the bench 220. As described more fully below, a leg (or third) cable-and-pulley subassembly 210 is coupled to the leg station 204, and in conjunction with other components, operatively couples the leg station 204 to a weight stack 205. As shown in FIG. 2, a shroud 207 is disposed about the weight stack 205.

Figure 1:
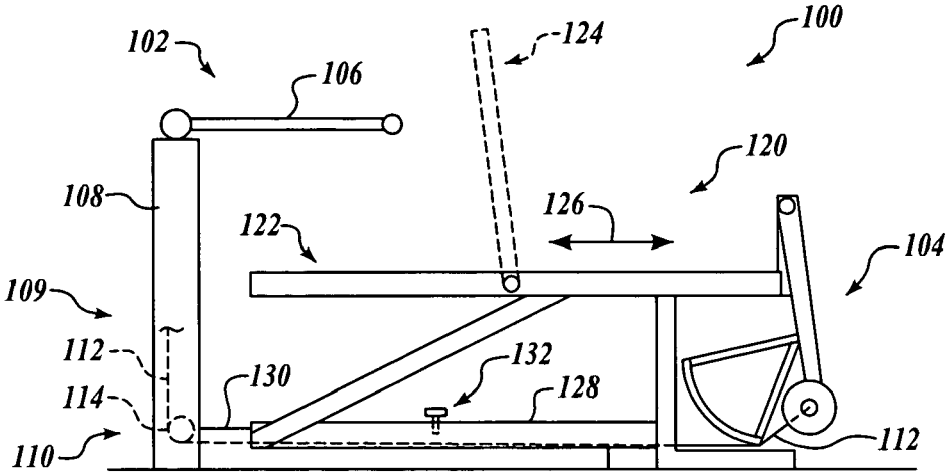
FIG.1 (PRIOR ART)
FIG. 1 is a side elevational view of a portion of an exercise machine that includes a bench in accordance with the prior art.
Figure 4:
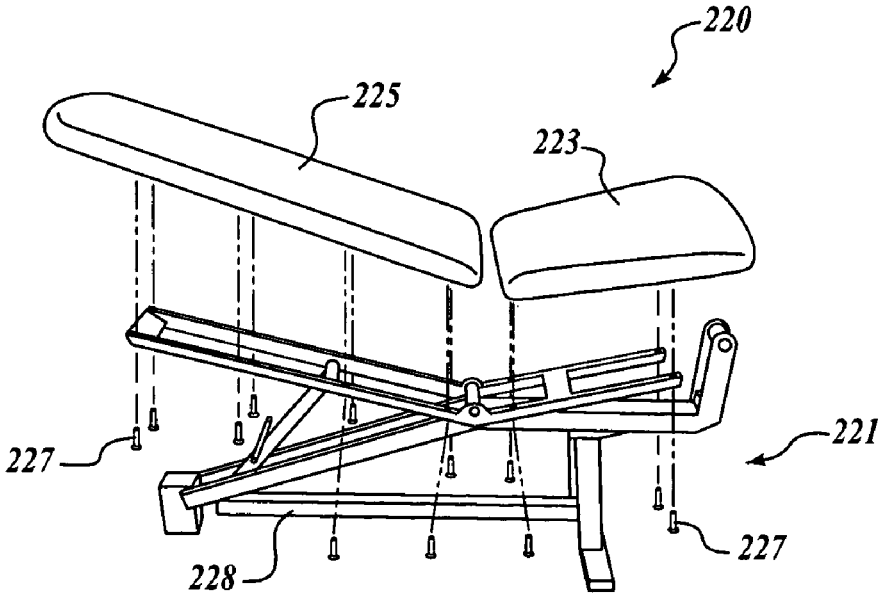
FIG. 4 is a partially-exploded isometric view of the moveable bench of FIG. 3.

FIG. 4 is a partially-exploded isometric view of the moveable bench 220 of FIGS. 1 and 2. In this embodiment, the bench 220 includes a bench support assembly 221 having a first portion 223 and a second portion 225 coupled thereto using a plurality of fasteners 227. As best shown in FIG. 3, an engagement member 228 of the support assembly 221 is adapted to slideably engage the first horizontal member 230 of the support frame 209. A user may pivot the second portion 225 into a first position 222 (FIG. 3) that supports the user in a supine or prone position, or into a second position 224 that supports the user in a sitting position.

Referring again to FIG. 2, the exercise machine 200 further includes a lat pull (or high pulley) station 232, a butterfly station 234, and a low pulley station 236. The lat pull station 232 includes a lat bar 238 positioned at an end of a reach arm 240 that extends outwardly from an upper end of a second upright member 242. The butterfly station 234 includes a seat 244 positioned atop a third upright member 246 of the support frame 209, and a pair of moveable swing arms 248 operatively coupled to the support frame 209 and positioned proximate the seat 244. Thus, while seated on the seat 244, a user may perform exercises using the lat pull station 232 and the butterfly station 234. The low pulley station 236 is positioned near a lower end of the first upright member 208, and is typically used by standing proximate the first upright member 208.

Figure 5:
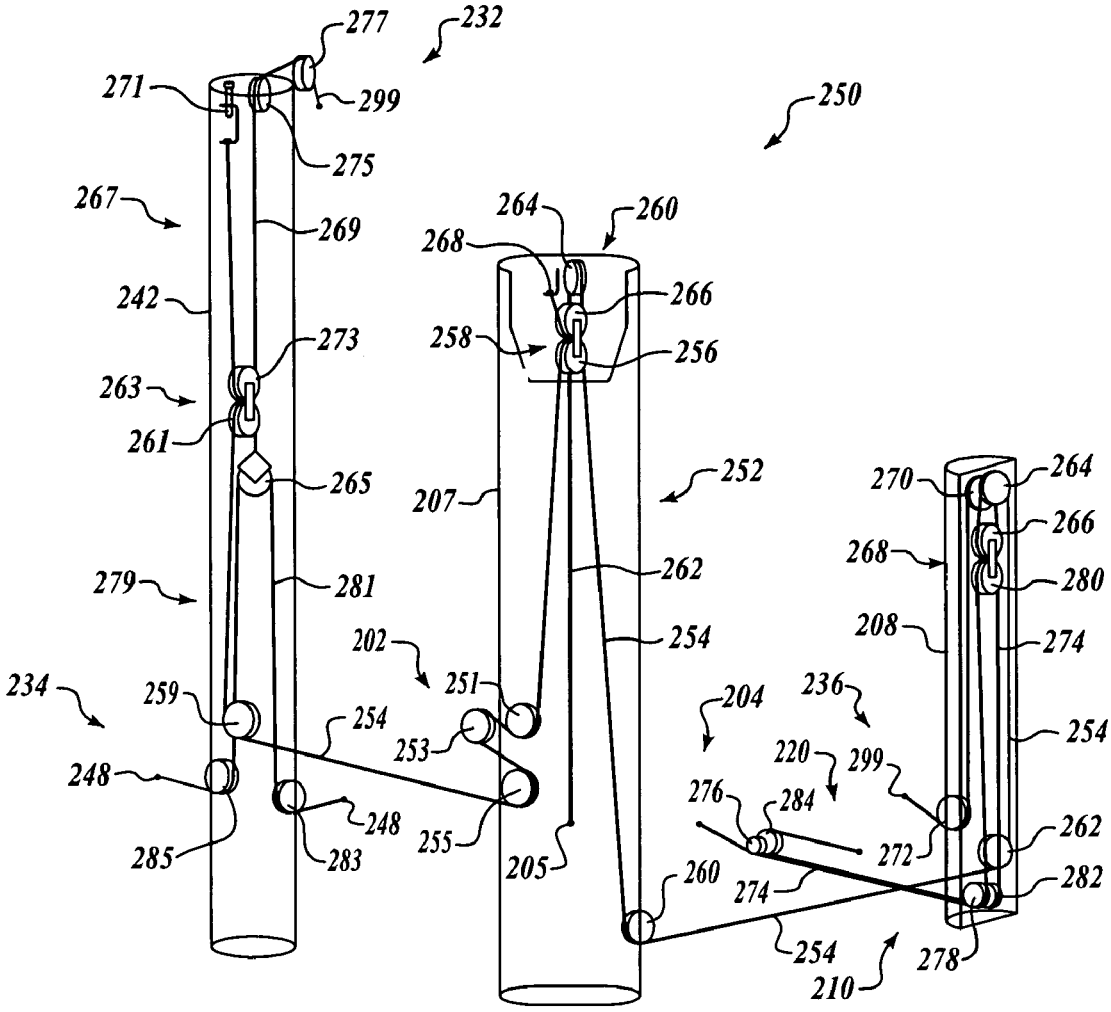
FIG. 5 is a schematic view of a cable-and-pulley assembly of the exercise machine of FIG. 2.

FIG. 5 is a schematic view of a cable-and-pulley assembly 250 of the exercise machine 200 of FIG. 2. In this embodiment, a first cable-and-pulley subassembly 260 includes a first cable 262 coupled to the weight stack 205 and extending upwardly through the shroud 207. The first cable 262 is engaged onto a first guide pulley 264 and an upper pulley 266 of a first double floating pulley 258. The first cable 262 terminates at a first anchor point 268 proximate an upper end of the shroud 207.

A second cable-and-pulley subassembly 252 includes a second cable 254 that is engaged onto a lower pulley 256 of the first double floating pulley 258 within the shroud 207. The second cable 254 is further engaged onto a second guide pulley 260 proximate a lower portion of the shroud 207, a third guide pulley 262 proximate a lower end of the first upright member 208, and a fourth guide pulley 264 proximate an upper end of the first upright member 208. The second cable 254 then engages onto an upper pulley 266 of a second double floating pulley 268, and onto fifth and sixth guide pulleys 270, 272 before terminating at the low pulley station 236. In this embodiment, a stop 299 is coupled to the second cable 254 proximate the low pulley station 236.

The second cable 254 also extends from the first double floating pulley 258 within the shroud 207 to seventh, eighth, and ninth pulleys 251, 253, 255 operatively associated with the press station 202. The second cable 254 then engages onto a tenth guide pulley 259 proximate a lower portion of the second upright member 242, and engages onto a lower pulley 261 of a third double floating pulley 263 before terminating at a single floating pulley 265.

Figure 6:
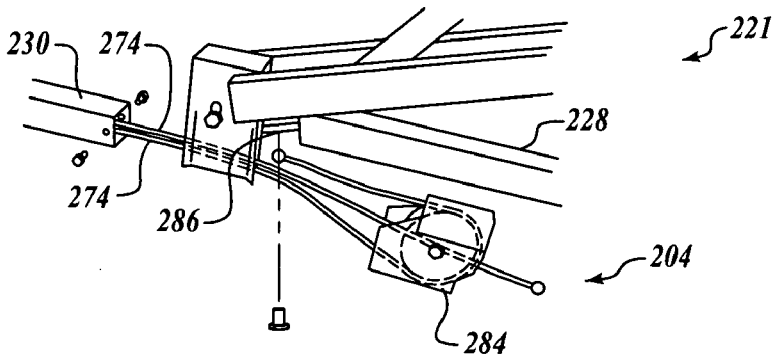
FIG. 6 is an enlarged, partially-exploded isometric view of a counteracting force assembly of the exercise machine of FIG. 2.

As further shown in FIG. 5, the third (or leg) cable-and-pulley subassembly 210 includes a third cable 274 having a first end coupled to the leg station 204. The third cable 274 is engaged onto eleventh and twelfth guide pulleys 276, 278, and extends upwardly through the first upright member 270 to engage onto a lower pulley 280 of the second double floating pulley 268. The third cable 274 further then engages onto a thirteenth guide pulley 282 and extends outwardly along the first horizontal member 230 of the support frame 209 (FIG. 3). As best shown in FIGS. 3 and 6, the third cable 274 then engages onto a fourteenth guide pulley 284 that is coupled to the first horizontal member 230, and then extends back along the engagement member 228 to attach at a termination point 286 on the bench support assembly 221.

As an exercising force is exerted on the leg station 204, one or more of the various cable-and-pulley subassemblies of the cable-and-pulley assembly 250 are tensioned and cooperate such that a corresponding force is transmitted through the third cable 254, the second cable 254, and the first cable 262 to the weight stack 205. Except for inventive aspects of the cable-and-pulley assembly 250 in accordance with the present invention, the tensioning and cooperation of the one or more cable-and-pulley subassemblies is generally known and is described more fully, for example, in the above-referenced U.S. Pat. No. 5,779,601 issued to Ish, and in U.S. Pat. No. RE 34,572 issued to Johnson et al., which patent is incorporated herein by reference.

It will be appreciated that if a user desires to move the moveable bench 220 along a lengthwise axis 226 (FIG. 3), the user may simply push or pull the moveable bench 220 in the desired direction until the desired position is achieved. Significantly, there is no need for the user to disconnect the leg station 204 from the third cable 274 in order to move the moveable bench 220. The third cable 274 is operatively coupled between the leg station 204 and the termination point 286 on the bench support assembly 221 so that as the moveable bench 220 is repositioned, the engagement member 228 slides over the first horizontal member 230 and the third cable 274 is simply drawn over the pulleys 276-284 of the third cable-and-pulley subassembly 210. Once the moveable bench 220 is placed in the desired position, the user may perform exercises using the press station 202 or the leg station 204. There is no need for the user to reconnect the leg station 204 to the third cable 274 after moving the moveable bench 220.

Also, there is also no slack created in the third cable 274 due to the movement of the moveable bench 220 and the movement of the leg station 204, and thus no need for any extraneous activity by the user to prepare for performing an exercise. As the user pulls out the moveable support, the third cable 274 is automatically pulled out by the appropriate amount, but a counter reactive movement has released the same amount of cable into the apparatus. This advantageously maintains all exercise stations in a ready status at any moveable support location with no additional adjustment. Once the moveable bench 220 is repositioned, the user may begin exercising immediately using the desired exercise station.

In accordance with another inventive aspect of the present invention, as the leg station 204 is used during at least some types of exercises, a horizontal force that may be exerted on the moveable bench 230 along the lengthwise axis 226 due to the exercise may be at least partially counteracted by the coupling of the third cable 274 to the bench support assembly 221. More specifically, as the user exerts a force on a swing arm 288 of the leg station 204 to cause the swing arm 288 to swing upwardly along an arc 290 (FIG. 3), the user's body exerts a first horizontal force 292 that tends to push the moveable bench 220 toward the first upright member 208. Due to the configuration of the third cable-and-pulley subassembly 210 in combination with the other components of the exercise machine 200, however, the third cable 274 exerts a second horizontal force 294 on the bench support assembly 221 that tends to at least partially counteract the first horizontal force 292.

Although the frictional forces between the engagement member 228 of the moveable bench 220 and the first horizontal member 230 of the support frame 209 may be great enough to prevent the moveable bench 130 from sliding on the first horizontal member 230 when the user is seated on the moveable bench 130, the second horizontal force 294 tends to at least partially counteract the first horizontal force 292, thereby at least partially inhibiting or preventing the moveable bench 220 from moving along the lengthwise axis 226 during the exercise. After the exercise is completed, the first and second horizontal forces 292, 294 are relieved, and the moveable bench 220 may be easily repositioned along the first horizontal member 230 (or the lengthwise axis 226) as desired. Furthermore, while an exercise is being performed at another exercise station (e.g. a lat pull down exercise using the lat pull station 232), the moveable bench 220 may be moved in and out even though the third cable 274 is tensioned.

It will be appreciated that in some embodiments, a user may use the leg station 204 in such a way that does not generate the first horizontal force 292. Alternately, the leg station 204 may be used in a manner that reverses the first horizontal force 292 from the direction shown in FIG. 3. For example, if the leg station 204 is moved into an upper position with respect to the moveable bench 220 and lies in a prone position to perform hamstring curls using the leg station 204, as disclosed, for example, in U.S. Pat. No. 5,672,143 issued to Ish, the first horizontal force 292 may be directed oppositely from that shown in FIG. 3. Therefore, the particular force diagram shown in FIG. 3 is representative of some (but not all) embodiments and modes of operation of the exercise machine 200.

In some embodiments, at least one of the first and second horizontal forces 292, 294 may not be entirely horizontal, but rather, may represent a horizontal component of a generally non-horizontal total force. In other embodiments, the second horizontal force 294 may be approximately equal to the first horizontal force 292. In still other embodiments, however, the second horizontal force 294 may be different than (e.g. less than) the first horizontal force 292, and may be insufficient to prevent the moveable bench 230 from moving without the help of frictional forces between the engagement member 228 of the moveable bench 230 and the first horizontal member 230 of the support frame 209. In one particular embodiment, the second horizontal force 294 may be less than the first horizontal force 292 which causes the moveable bench 230 to be pulled toward the first upright member 208. In this case, a locking assembly of the type described above (FIG. 1) may be desirable, or alternately, the user may move the moveable bench 230 fully toward the pulley 284 so that the moveable bench 230 abuts against the pulley 284 to prevent movement of the moveable bench 230 along the lengthwise axis 226 during this exercise.

In still other embodiments, at least one of the first and second horizontal forces 292, 294 may not be generated at all during some types of exercises, or may not be generated during use of at least some of the various exercise stations of the exercise machine. In other words, the first and second horizontal forces 292, 294 may, but are not necessarily, generated by the user during an exercise.

Although the exercise machine 200 is described above and shown in the accompanying figures as having a weight stack 205, it will be appreciated that in alternate embodiments, a wide variety of devices may be used to provide the desired training load. For example, in alternate embodiments, the weight stack 205 may be replaced with a single weight, or with one or more hydraulic or pneumatic resistance devices, springs, stretchable bands, flexible rods, resilient members, bendable members, or any other suitable type of training load.

The components and operation of the remaining exercise stations of the exercise machine 200 will now be described. Referring again to FIG. 5, in this embodiment, the cable-and-pulley assembly 250 includes a fourth cable-and-pulley subassembly 267 operatively associated with the lat pull station 232. The fourth cable-and-pulley subassembly 267 has a fourth cable 269 coupled to a second anchor point 271 proximate an upper end of the second upright member 242. The fourth cable 269 engages onto an upper pulley 273 of the third double floating pulley 263, and onto fifteenth and sixteenth guide pulleys 275, 277 before terminating at the lat pull station 232. In this embodiment, a stop 299 is coupled to the fourth cable 269 proximate the lat pull station 232. As an exercising force is exerted on the lat bar 233 of the lat pull station 232, various portions of the cable-and-pulley assembly 250 are tensioned and cooperate such that a corresponding force is transmitted through the fourth cable 269, the second cable 254, and the first cable 262 to the weight stack 205.

Furthermore, a fifth cable-and-pulley subassembly 279 is associated with the butterfly station 234, and includes a fifth cable 281 engaged onto the single floating pulley 265. The fifth cable 281 is then engaged onto seventeenth and eighteenth guide pulleys 283, 285, and each end of the fifth cable 281 terminates at a swing arm 248 of the butterfly station 234. As an exercising force is exerted on one or both of the swing arms 248 of the butterfly station 234, various portions of the cable-and-pulley assembly 250 are tensioned and cooperate such that a corresponding force is transmitted through the fifth cable 281, the second cable 254, and the first cable 262 to the weight stack 205.

Figure 7:
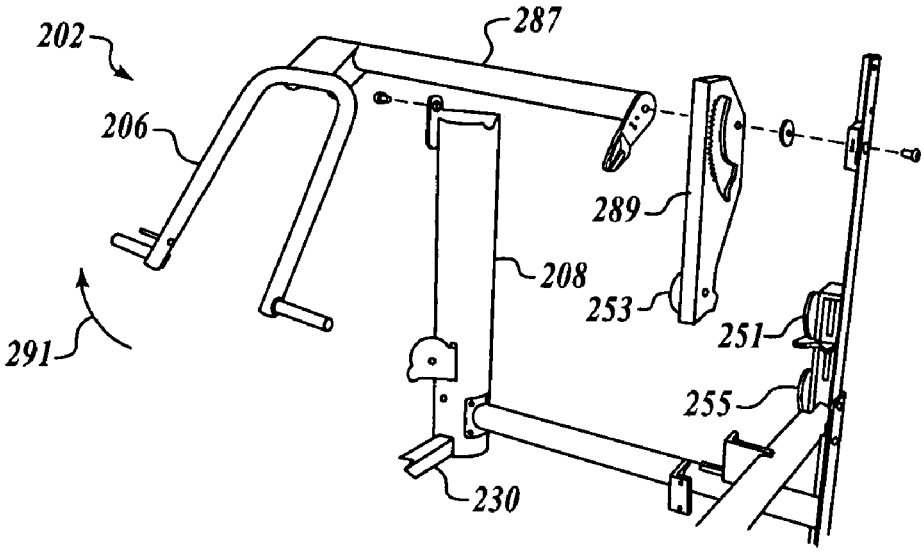
FIG. 7 is a partially-exploded isometric view of the press station of the exercise machine of FIG. 2.
Figure 8:
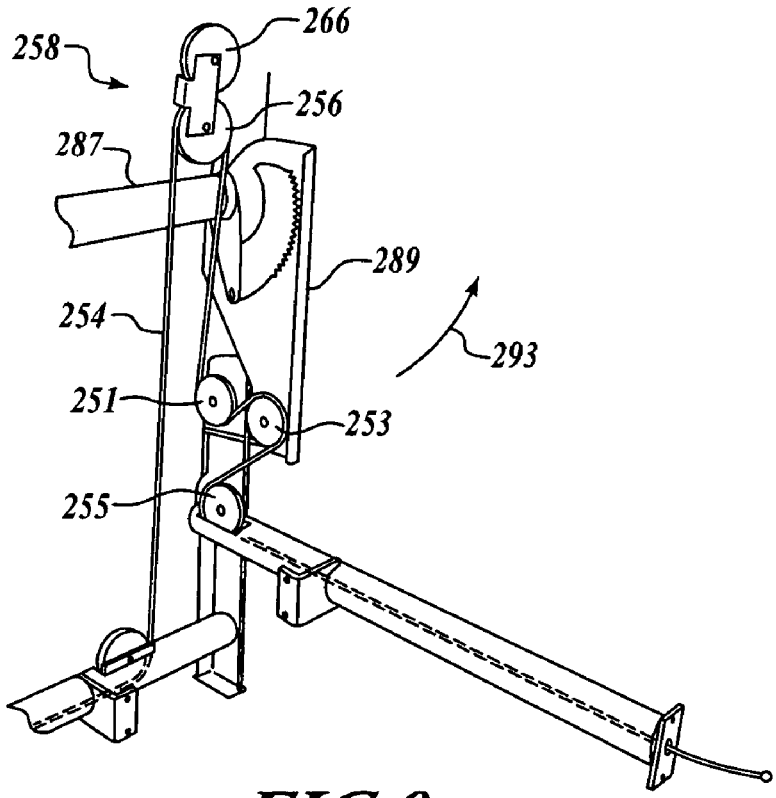
FIG. 8 is a partial isometric view of the press station of the exercise machine of FIG. 2.

The operation of the press arm station 202 will be described with reference to FIGS. 7 and 8, which show partially-exploded and partial isometric views, respectively, of the press station 202. In this embodiment, the press arm 206 is coupled to a transfer member 287 that extends horizontally from approximately the press station 202 to approximately the shroud 207. A swing plate 289 is coupled to the transfer member 287 and to the eighth pulley 253 of the second cable-and-pulley subassembly 252. As a user exerts a lifting force on the press arm 206 and causes the press arm 206 to rotate upwardly along an arc 291 (FIG. 7), the transfer member 287 is rotated and causes the eighth pulley 253 to move along an arc 293 (FIG. 8). The seventh and ninth pulleys 251, 255 remain fixed in position relative to the eighth pulley 253 during this movement. Various portions of the cable-and-pulley assembly 250 are then tensioned and cooperate such that a corresponding force is transmitted through the second cable 254 and the first cable 262 to the weight stack 205.

It will be appreciated that, in alternate embodiments, it is not necessary that cable-and-pulley assemblies (and subassemblies) be used. A variety of known force-transmitting mechanisms may be used instead of cable-and-pulley assemblies, including, for example, belts, chains, levers, linkages, direct drives, hydraulic systems, and other suitable force-transmitting assemblies.

Figure 9:
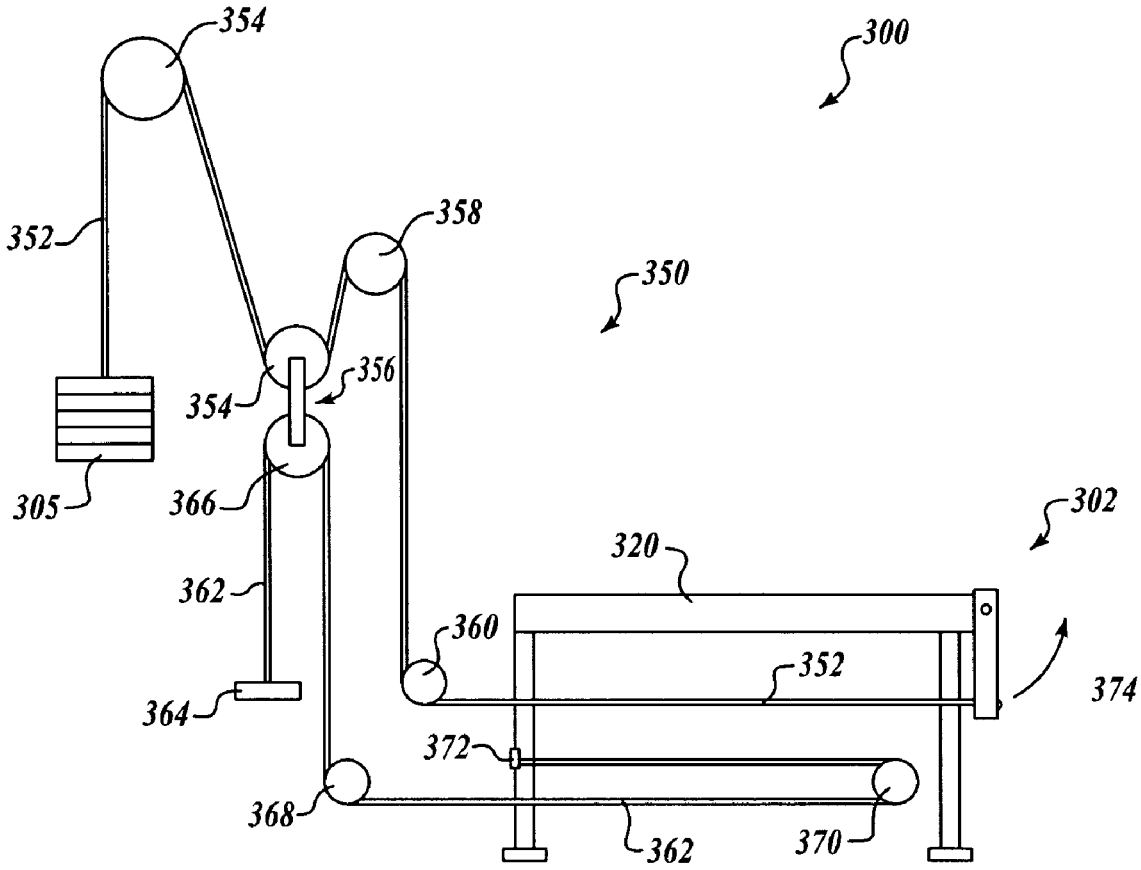
FIG. 9 is a schematic view of an exercise machine in accordance with an alternate embodiment of the present invention.

Of course, a variety of alternate embodiments of apparatus and methods in accordance with the present invention may be conceived, and the invention is not limited to the particular embodiments described above or shown in the accompanying figures. For example, FIG. 9 is a schematic view of an exercise machine 300 in accordance with an alternate embodiment of the present invention. In this embodiment, the exercise machine 300 includes an exercise station 302 coupled to a moveable support 320. A force-transferring assembly 350 operatively couples a training load 305 (e.g. a weight stack) to the leg station 302. More specifically, the force-transferring assembly 350 includes a first coupling member 352 coupled to the training load 305 and engaged onto a first guide member 354, an upper guide member 356 of a floating guide member assembly 356, second and third guide members 358, 360, and is coupled to the leg station 302. A second coupling member 362 has a fixed portion 364, and is engaged onto a lower guide member 366 of the floating guide member assembly 356, is engaged onto fourth and fifth guide members 368, 370, and is coupled to the moveable support 320 at a termination point 372. In some embodiments, the coupling members may be cables and the guide members may be pulleys.

In operation, as a user exerts a training force on the exercise station 302 to pull the first coupling member along the direction 374, a tension is formed in the first and second coupling members 352, 362. If the training force is sufficient, the training load 305 may be raised. As described more fully above, a reactive force exerted on the moveable support 320 during the exercise may be at least partially counter acted by a force exerted by the second coupling member 362 on the moveable support 320 at the termination point 372. It will therefore be appreciated that the above-noted inventive aspects of the present invention may be achieved using apparatus having a first coupling member 352 coupled to the exercise station 302 and a second coupling member 352 coupled to the moveable support 320, the first and second coupling members 352, 362 being operatively coupled to achieve the desired functionality and to provide the desired inventive results.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. An exercise machine configured to rest on a support surface, comprising:

a load;

a support frame operatively positioned relative to the load and having an outwardly extending guide member configured to extend along the support surface;

a first exercise station coupled to the support frame;

a moveable support having a first end portion positioned at least proximate to the first exercise station and a second end portion opposite the first end portion, the moveable support having an approximately horizontal portion configured to support a weight of a user during an exercise, the moveable support being slidably engaged with the outwardly extending guide member of the support frame and moveable along a movement axis;

a second exercise station operatively coupled to the second end portion of the moveable support; and wherein the force-transfering assembly is configured to allow the moveable support to move along the movement axis without a force-transferring assembly operatively coupling the second exercise station and the load and configured to transmit an exercising force exerted by the user on the second exercise station to the load, the force-transferring assembly including:

a pulley coupled to the outwardly extending guide member of the support frame proximate the second end portion of the moveable support, and a cable having a first end coupled to the moveable support and a second end coupled to the second exercise station, the cable extending from the first end to the pulley, operatively engaging the pulley, and extending back toward the first end portion of the moveable support, operatively engaging another portion of the force-transferring assembly, and extending back to the second exercise station, wherein the force-transferring assembly is configured to allow the moveable support to move along the movement axis without decoupling the force-transferring assembly from the second exercise station, and wherein the force-transferring assembly is further configured to apply a counter force on the moveable support that at least partially counters a reactive force applied by the user to the moveable support during use of the second exercise station.

2. The exercise machine of claim 1, wherein the moveable support comprises a bench adjustable between a first position configured to support the user in a supine position and a second position configured to support the user in a sitting position.

3. The exercise machine of claim 2, wherein the moveable support is moveable along a lengthwise axis, and wherein the reactive force and the counter force are approximately aligned with the movement axis of the moveable support.

4. The exercise machine of claim 2, wherein the reactive force is directed at least partially away from the second exercise station and the counter force is directed at least partially toward the second exercise station.

5. The exercise machine of claim 1, wherein the moveable support comprises a moveable bench having a bench support assembly, a first portion coupled to the bench support assembly, and a second portion pivotably coupled to at least one of the bench support assembly and the first portion.

6. The exercise machine of claim 1, wherein the force-transferring assembly comprises a cable-and-pulley assembly.

7. The exercise machine of claim 1, wherein the another portion of the force-transferring assembly comprises a floating pulley.

8. The exercise machine of claim 1, wherein the force-transferring assembly includes a first coupling member having a first portion coupled to the second exercise station and a second coupling member having a second portion coupled to the moveable support, the first and second coupling members being operatively coupled such that a first tension generated in the first coupling member generates a corresponding tension in the second coupling member.

9. The exercise machine of claim 1, wherein the second exercise station comprises a leg exercise station.

10. The exercise machine of claim 1, wherein the pulley is coupled to a portion of the outwardly extending guide member of the support frame that extends beyond at least a portion of the moveable support.

11. The exercise machine of claim 1, wherein the second exercise station is operatively coupled to the force-transferring assembly, the force-transferring assembly being further configured to transmit a second exercising force exerted by the user on the second exercise station to the load.

12. The exercise machine of claim 1, wherein the moveable support comprises a moveable bench and wherein the second exercise station comprises a leg station positioned at least proximate an end of the moveable bench.

13. An exercise machine configured to rest on a support surface, comprising:

a load;

a support frame operatively positioned relative to the load and having an outwardly extending guide member configured to extend along the support surface;

a moveable support having a first end portion and a second end portion opposite the first end portion, the moveable support having an approximately horizontal portion configured to support a weight of a user during an exercise, the moveable support being slidably engaged with the outwardly extending guide member of the support frame and moveable along a movement axis;

an exercise station operatively coupled to the second end portion of the moveable support; and a cable-and-pulley assembly operatively coupling the exercise station and the load and configured to transmit an exercising force exerted by the user on the exercise station to the load, the cable-and-pulley assembly including:

a pulley coupled to the outwardly extending guide member of the support frame proximate the second end portion of the moveable support, and a cable having a first end coupled to the moveable support and a second end coupled to the exercise station, the cable extending from the first end to the pulley, operatively engaging the pulley, and extending back toward the first end portion of the moveable support, operatively engaging another portion of the cable-and-pulley assembly, and extending back to the exercise station, wherein the cable-and-pulley assembly is configured to allow the moveable support to move along the movement axis without decoupling the cable-and-pulley assembly from the exercise station, and wherein the cable-and-pulley assembly is further configured to apply a counter for moveable support that at least partially counters a reactive force applied by the user to the moveable support during the exertion of the exercising force use of the exercise station.

14. The exercise machine of claim 13, wherein the moveable support comprises a bench adjustable between a first position configured to support the user in a supine position and a second position configured to support the user in a sitting position.

15. The exercise machine of claim 14, wherein the moveable support is moveable along a lengthwise axis, and wherein the reactive force and the counteracting force are approximately aligned with the movement axis of the moveable support.

16. The exercise machine of claim 14, wherein the reactive force is directed at least partially away from the exercise station and the counteracting force is directed at least partially toward the exercise station.

17. The exercise machine of claim 13, wherein the moveable support comprises a moveable bench having a bench support assembly, a first portion coupled to the bench support assembly, and a second portion pivotably coupled to the bench support assembly.

18. The exercise machine of claim 13, wherein the another portion of the cable-and-pulley assembly comprises a floating pulley.

19. The exercise machine of claim 13, wherein the pulley is coupled to a portion of the outwardly extending guide member that extends beyond at least a portion of the moveable support.

20. The exercise machine of claim 13, further comprising a second exercise station operatively coupled to the cable-and-pulley assembly, the cable-and-pulley assembly being further adapted to transmit a second exercising force exerted by the user on the second exercise station to the load.

21. The exercise machine of claim 13, wherein the moveable support comprises a moveable bench and wherein the exercise station comprises a leg station positioned at least proximate an end of the moveable bench.

22. An exercise machine, comprising:

a load;

a support frame operatively positioned relative to the load and having an outwardly extending guide member;

a moveable support having a first end portion and a second end portion opposite the first end portion, the moveable support having an approximately horizontal portion configured to support a weight of a user during an exercise, the moveable support being slidably engaged with the outwardly extending guide member of the support frame and moveable along a movement axis of the moveable support;

an exercise station operatively coupled to the second end portion of the moveable support; and a force-transferring assembly operatively coupling the exercise station and the load and configured to transmit an exercising force exerted by the user on the exercise station to the load, the force-transferring assembly further being operatively coupled to the moveable support and configured to apply a counter force on the moveable support that at least partially counters a reactive force applied by the user to the moveable support during the exertion of the exercising force during at least one type of exercise, wherein the force-transferring assembly includes:

a cable guide coupled to the outwardly extending guide member of the support frame proximate the second end portion of the moveable support, and a cable having a first end coupled to the moveable support and a second end coupled to the exercise station, the cable extending from the first end to the cable guide, operatively engaging the cable guide, and extending back toward the first end portion of the moveable support, operatively engaging another portion of the force-transferring assembly, and extending back to the exercise station.

23. The exercise machine of claim 22, wherein the force-transferring assembly is further configured to allow the moveable support to move along the movement axis without decoupling the force-transferring assembly from the exercise station.

24. The exercise machine of claim 22, wherein the moveable support is moveable along a lengthwise axis, and wherein the reactive force and the counter force are approximately aligned with the lengthwise axis of the moveable support.

25. The exercise machine of claim 22, wherein the cable guide comprises a pulley, and wherein the another portion of the force-transferring assembly comprises a floating pulley.

26. The exercise machine of claim 22, wherein the force-transferring assembly includes a first coupling member having a first portion coupled to the exercise station and a second coupling member having a second portion coupled to the moveable support, the first and second coupling members being operatively coupled such that a first tension generated in the first coupling member generates a corresponding tension in the second coupling member.

27. The exercise machine of claim 22, wherein the guide member is coupled to a portion of the outwardly extending guide member that extends beyond at least a portion of the moveable support.

28. The exercise machine of claim 22, wherein the exercise station comprises a leg station.

29. The exercise machine of claim 22, wherein the moveable support comprises a moveable bench and wherein the exercise station comprises a leg station positioned at least proximate an end of the moveable bench.

30. An exercise machine, comprising:

a load;

a support frame operatively positioned relative to the load and having an outwardly extending guide member;

a first exercise station coupled to the support frame;

a moveable support having a first end portion positioned at least proximate to the first exercise station and a second end portion opposite the first end portion, the moveable support having an approximately horizontal portion configured to support a weight of a user during an exercise, the moveable support being slidably engaged with the outwardly extending guide member of the support frame and moveable along a movement axis;

a second exercise station operatively coupled to the second end portion of the moveable support; and a cable-and-pulley assembly operatively coupling the second exercise station and the load and configured to transmit an exercising force exerted by the user on the second exercise station to the load, the cable-and-pulley assembly including:

a cable guide coupled to the outwardly extending guide member of the support frame proximate the second end portion of the moveable support, and a cable having a first end coupled to the moveable support and a second end coupled to the second exercise station, the cable extending from the first end to the cable guide, operatively engaging the cable guide, and extending back toward the first end portion of the moveable support, operatively engaging another portion of the force-transferring assembly, and extending back to the second exercise station, wherein the cable-and-pulley assembly is configured to apply a counter force on the moveable support that at least partially counters a reactive force applied by the user to the moveable support during the exertion of the exercising force during at least one type of exercise.

31. The exercise machine of claim 30, wherein the cable-and-pulley assembly is further configured to allow the moveable support to move without decoupling the cable-and-pulley assembly from the exercise station.

32. The exercise machine of claim 30, wherein the moveable support is moveable along a lengthwise axis, and wherein the reactive force and the counteracting force are approximately aligned with the lengthwise axis of the moveable support.

33. The exercise machine of claim 30, wherein the reactive force is directed at least partially away from the exercise station and the counteracting force is directed at least partially toward the exercise station.

34. The exercise machine of claim 30, wherein the cable guide comprises a pulley, and wherein the another portion of the force-transferring assembly comprises a floating pulley.

35. The exercise machine of claim 30, wherein the cable guide is coupled to a portion of the outwardly extending guide member extending beyond at least a portion of the moveable support.

36. The exercise machine of claim 30, wherein the second exercise station is operatively coupled to the cable-and-pulley assembly, being further configured to transmit a second exercising force exerted by the user on the second exercise station to the load.

37. The exercise machine of claim 30, wherein the moveable support comprises a moveable bench and wherein the exercise station comprises a leg station positioned at least proximate an end of the moveable bench.

* * * * *